US008106707B2

(12) United States Patent
Katyal et al.

(10) Patent No.: US 8,106,707 B2
(45) Date of Patent: Jan. 31, 2012

(54) CURVATURE COMPENSATED BANDGAP VOLTAGE REFERENCE

(75) Inventors: Vipul Katyal, Fort Collins, CO (US); Mark Rutherford, Wellington, CO (US)

(73) Assignee: Broadcom Corporation, Irvine, CA (US)

( * ) Notice: Subject to any disclaimer, the term of this patent is extended or adjusted under 35 U.S.C. 154(b) by 386 days.

(21) Appl. No.: 12/498,947

(22) Filed: Jul. 7, 2009

(65) Prior Publication Data

US 2010/0301832 A1 Dec. 2, 2010

Related U.S. Application Data

(60) Provisional application No. 61/182,482, filed on May 29, 2009.

(51) Int. Cl.
*G05F 1/10* (2006.01)

(52) U.S. Cl. ..... 327/539; 323/313; 323/907

(58) Field of Classification Search ..... 327/512, 327/513, 540–545, 307, 538; 323/312–316, 323/901, 906, 907
See application file for complete search history.

(56) References Cited

U.S. PATENT DOCUMENTS

| | | | | |
|---|---|---|---|---|
| 5,686,821 | A * | 11/1997 | Brokaw | 323/273 |
| 6,157,245 | A * | 12/2000 | Rincon-Mora | 327/539 |
| 6,366,071 | B1 * | 4/2002 | Yu | 323/316 |
| 6,462,612 | B1 * | 10/2002 | Roh et al. | 327/539 |
| 7,710,190 | B2 * | 5/2010 | Oberhuber | 327/512 |

OTHER PUBLICATIONS

Andy, Jonathan M., "3rd order curvature corrected Bandgap Cell," Circuits and Systems, IEEE, Proceedings of the 38th Midwest Symposium, p. 397-400, 1996.

Avoinne, C., et al., "Second-order compensated bandgap reference with convex correction,"Electronics Letters, vol. 41, No. 5, 2 pages, Mar. 3, 2005.

Azarkan, Ahmidou et al., "A Low-Noise Bandgap Reference Voltage Source with Curvature Correction," IEEE International Symposium on Circuits and Systems, p. III-205-III-208, 2002.

Chen, Jianghua et al., "A High Precision Curvature Compensated Bandgap Reference without Resisitors," IEEE 8th International Conference on Solid-State and Integrated Circuit Technology, 3 pages, Oct. 2006.

Dai, Xin, et al., "Explicit Characterization of Bandgap References," in Proc. ISCAS 2006, p. 573-576, May 2006.

He, Jun, et al., "A Detailed Analysis of Nonideal Effects on High Precision Bandgap Voltage References," IEEE 51st Midwest Symposium on Circuits and Systems, p. 382-385, Aug. 2008.

Hoon, Siew Kuok et al., "An Improved Bandgap Reference with High Power Supply Rejection," IEEE International Symposium on Circuits and Systems, p. V-833-V-836, 2002.

(Continued)

*Primary Examiner* — Rajnikant Patel

(74) *Attorney, Agent, or Firm* — Sterne, Kessler, Goldstein & Fox P.L.L.C.

(57) ABSTRACT

Embodiments of the present invention include systems and methods for generating a curvature compensated bandgap voltage reference. In an embodiment, a curvature compensated bandgap reference voltage is achieved by injecting a temperature dependent current at different points in the bandgap reference voltage circuit. In an embodiment, the temperature dependent current is injected in the proportional to absolute temperature (PTAT) and complementary to absolute temperature (CTAT) current generation block of the bandgap circuit. Alternatively, or additionally, the temperature dependent current is injected at the output stage of the bandgap circuit. In an embodiment, the temperature dependent current is a linear piecewise continuous function of temperature. In another embodiment, the temperature dependent current has opposite dependence on temperature to that of the bandgap voltage reference before curvature compensation.

19 Claims, 11 Drawing Sheets

OTHER PUBLICATIONS

Jiang, Yueming et al., "A 1.2 V Bandgap Reference Based on Transimpedance Amplifier," IEEE, International Symposium on Circuits and Systems, p. IV-261-IV-264, May 28-31, 2000.

Jiang, Yueming et al., "A Low Voltage Low 1/f Noise CMOS Bandgap Reference," IEEE International Symposium on Circuits and Systems, p. 3887-3880, 2005.

Jun, Cheng et al., "A CMOS Bandgap Reference Circuit," IEEE 4th International Conference on ASIC, p. 271-273, 2001.

Ker, Ming-Dou et al., "New Curvature-Compensation Technique for CMOS Bandgap Reference with Sub-1-V Operation," IEEE International Symposium on Circuits and Systems, p. 3861-3864, 2005.

Qin, Bo et al., "A 1V MNC Bandgap Reference with High Temperature Stability," IEEE International Conference on Communications, Circuits and Systems, p. 2205-2209, 2006.

Rincon-Mora, Gabriel et al., "A 1.1-V Current-Mode and Piecewise-Linear Curvature-Corrected Bandgap Reference," IEEE J. Solid-State Circuits, vol. 33, No. 10, p. 1551-1554, Oct. 1998.

Salminen, O. et al., "The Higher Order Temperature Compensation of Bandgap Voltage References," Electronic Circuit Design Laboratory Report Series, p. 1388-1391, Nov. 1990.

Spady, David et al., "A CMOS bandgap voltage reference with absolute value and temperature drift trims," IEEE International Symposium on Circuits and Systems, p. 3853-3856, 2005.

Tadeparthy, Preetam, "A CMOS Bandgap Reference with Correction for Device-to-Device Variation," IEEE International Symposium on Circuits and Systems, p. I-397-I-4000, 2004.

Wang, Haibo et al., "An Improved Compensated-Temperature and High PSRR Bandgap Reference Circuit Design," IEEE 8th International Conference on Solid-State and Integrated Circuit Technology, 3 pages, 2006.

Xing, Xinpeng et al., "A Low Voltage High Precision CMOS Bandgap Reference," in Norchip, IEEE, 4 pages, 2007.

Ying, Song et al., "A Precise Compensated Bandgap Reference without Resistors," IEEE 7th International Conference on Solid-State and Integrated Circuits Technology, p. 1583-1586, 2004.

Zongmin, Wang et al., "Low Voltage, High Performance Bandgap Reference in Standard CMOS Technology," IEEE Int. Workshop VLSI Design & Video Tech., p. 17-20, May 28-30, 2005.

* cited by examiner

800

CURVATURE COMPENSATED BANDGAP VOLTAGE REFERENCE

CROSS-REFERENCE TO RELATED APPLICATIONS

The present application claims the benefit of U.S. Provisional Patent Application No. 61/182,482, filed May 29, 2009, which is incorporated herein by reference in its entirety.

BACKGROUND OF THE INVENTION

1. Field of the Invention

The present invention relates generally to bandgap voltage reference circuits.

2. Background Art

A bandgap voltage reference circuit is a circuit that generates a reference voltage (called bandgap voltage reference) with low temperature dependence.

In conventional bandgap voltage reference circuits, the bandgap voltage reference exhibits a parabolic (curvature) shape versus temperature, instead of a flat temperature-independent shape.

While a curvature shaped bandgap voltage reference is acceptable in many applications, certain high precision applications have much more exacting requirements for reference voltage stability versus temperature.

There is a need therefore for methods and systems that generate a curvature-compensated bandgap voltage reference.

BRIEF SUMMARY

The present invention relates generally to bandgap voltage reference circuits.

Embodiments include systems and methods for generating a curvature compensated bandgap voltage reference. In an embodiment, a curvature compensated bandgap reference voltage is achieved by injecting a temperature dependent current at different points in the bandgap voltage reference circuit. In an embodiment, the temperature dependent current is injected in the proportional to absolute temperature (PTAT) and complementary to absolute temperature (CTAT) current generation block of the bandgap circuit. Alternatively, or additionally, the temperature dependent current is injected at the output stage of the bandgap circuit. In an embodiment, the temperature dependent current is a linear piecewise continuous function of temperature. In another embodiment, the temperature dependent current has opposite dependence on temperature to that of the bandgap voltage reference before curvature compensation.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will be described with reference to the accompanying drawings. Generally, the drawing in which an element first appears is typically indicated by the leftmost digit(s) in the corresponding reference number.

DETAILED DESCRIPTION OF EMBODIMENTS

PTAT and CTAT Current Generation

A bandgap voltage reference circuit is a circuit that generates a reference voltage with low temperature dependence. In typical implementations, a bandgap voltage reference circuit generates two voltages having opposite temperature coefficients, and then combines the two voltages with proper weights to result in a voltage with low temperature dependence. In generating the two voltages, the bandgap voltage reference circuit can also generate two currents, known as the proportional to absolute temperature (PTAT) current and the complementary to absolute temperature (CTAT) current, as will be further described below.

Figure 1:
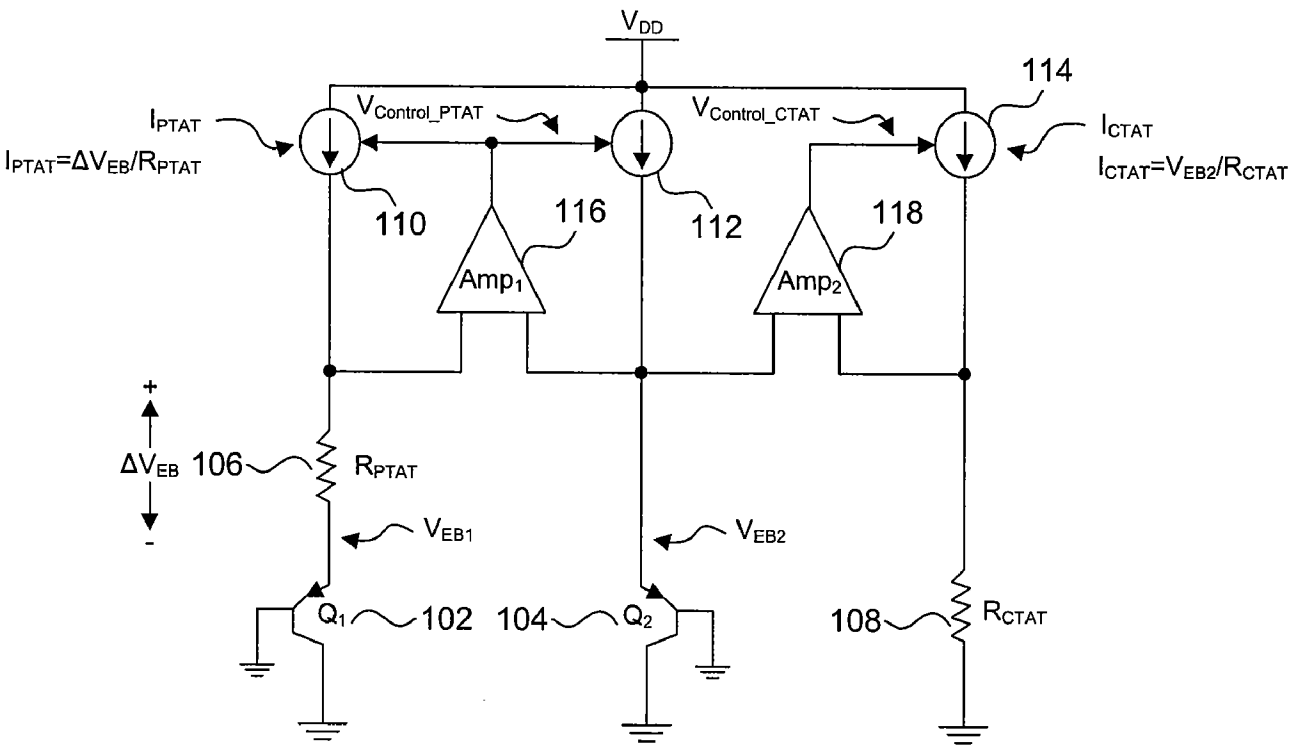
FIG. 1 illustrates an example circuit for generating PTAT and CTAT currents in a bandgap voltage reference circuit.

FIG. 1 illustrates an example circuit 100 for generating PTAT and CTAT currents in a bandgap voltage reference circuit. As shown in FIG. 1, example circuit 100 includes two bipolar junction transistors Q1 102 and Q2 104. Q1 102 and Q2 104 are operated at different current densities. For example, Q1 102 may have larger area than Q2 104, or less current flowing through it than Q2 104. In an implementation, Q1 102 includes a plurality of parallel-coupled transistors (e.g., 24), while Q2 104 includes a single transistor. Other transistor ratios could be used as will be understood by a person skilled in the art. Because Q1 102 is running at a lower current density than Q2 104, the voltage difference (illustrated as $\Delta V_{EB}$ in FIG. 1) between Q2's emitter-to-base voltage (illustrated as $V_{EB2}$ in FIG. 1) and Q1's emitter-to-base voltage (illustrated as $V_{EB1}$ in FIG. 1) is directly proportional to temperature.

The PTAT current is generated by creating a $\Delta V_{EB}$ voltage across a resistor $R_{PTAT}$ 106. In particular, amplifier 1 16 controls current sources 110 and 112 so that the voltage across Q2

104 is equal to the sum of the voltages across Q1 102 and $R_{PTAT}$ 106. The temperature coefficient of the PTAT current is affected by the temperature coefficients of both $\Delta V_{EB}$ and $R_{PTAT}$ 106.

The CTAT current is generated by creating a voltage having negative temperature dependence across a resistor $R_{CTAT}$ 108. In particular, the voltage across the PN junction of Q2 104 (i.e., the voltage $V_{EB2}$), which theoretically exhibits negative temperature dependence, is reproduced across $R_{CTAT}$ 108. In particular, amplifier 118 controls current source 114 so that the voltage across Q2 104 is equal to the voltage across resistor $R_{CTAT}$ 108. The temperature coefficient of the CTAT current is affected by the temperature coefficients of both $V_{EB2}$ and $R_{CTAT}$ 108.

Figure 2:
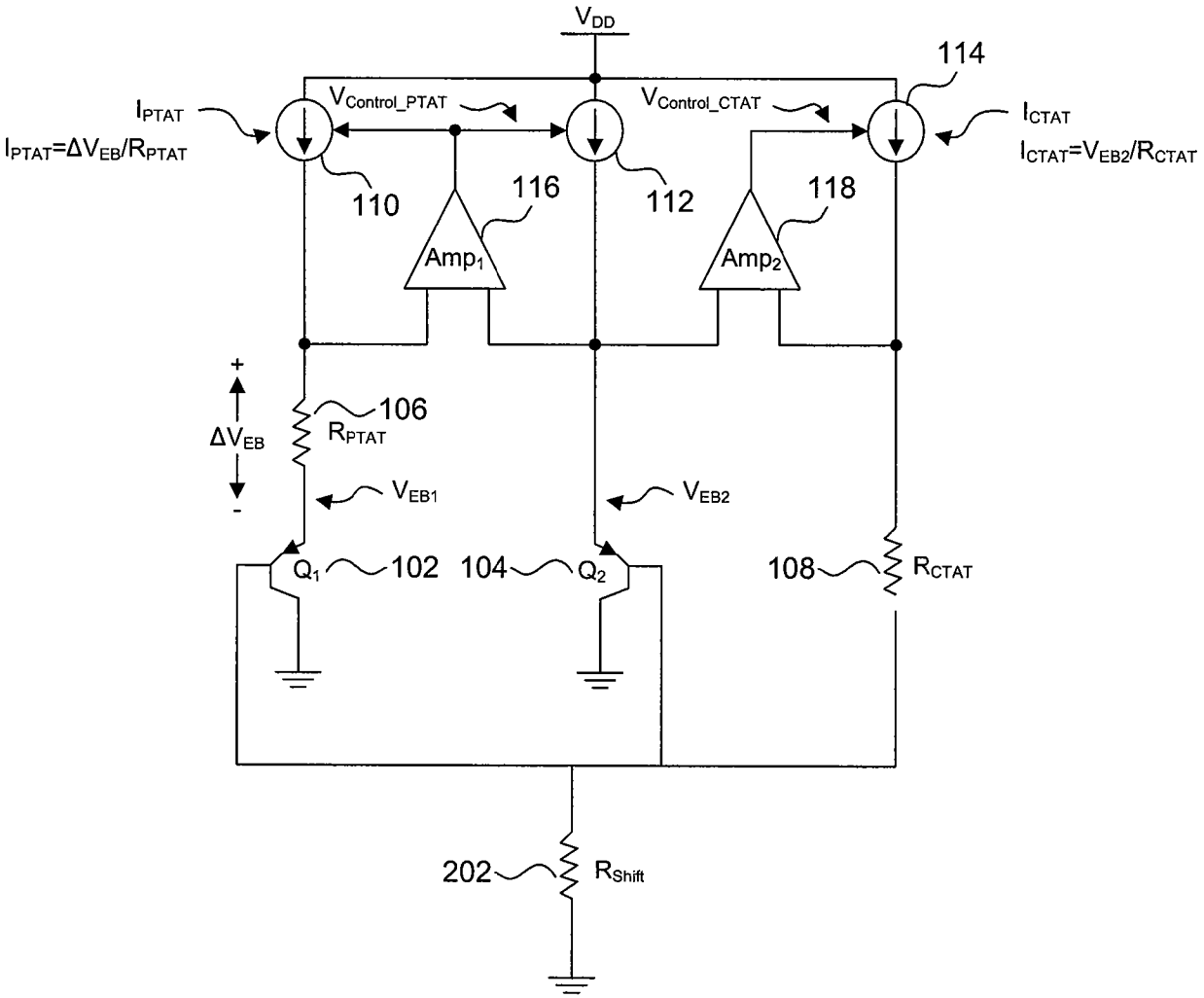
FIG. 2 illustrates another example circuit for generating PTAT and CTAT currents in a bandgap voltage reference circuit.

FIG. 2 illustrates another example circuit 200 for generating PTAT and CTAT currents in a bandgap voltage reference circuit. Example circuit 200 is substantially similar to example circuit 100, described above. In addition, example circuit 200 provides an implementation with boosted amplifier inputs, which may be needed for proper operation of certain amplifier processes (e.g., NMOS). Thus, as shown in FIG. 2, a resistor $R_{Shift}$ 202 is coupled between the base terminals of Q1 and Q2 and ground and between resistor $R_{CTAT}$ 108 and ground, which shifts up the input voltages of amplifiers 116 and 118.

As mentioned above, with proper weights, $I_{PTAT}$ and $I_{CTAT}$ can be used to generate a voltage with no or minimal temperature dependence. Typically, this can be achieved by mirroring currents $I_{PTAT}$ and $I_{CTAT}$ (e.g., using current mirror circuits, not shown) and combining the two mirrored currents across an output resistor in an output stage of the bandgap voltage reference circuit.

Figure 3:
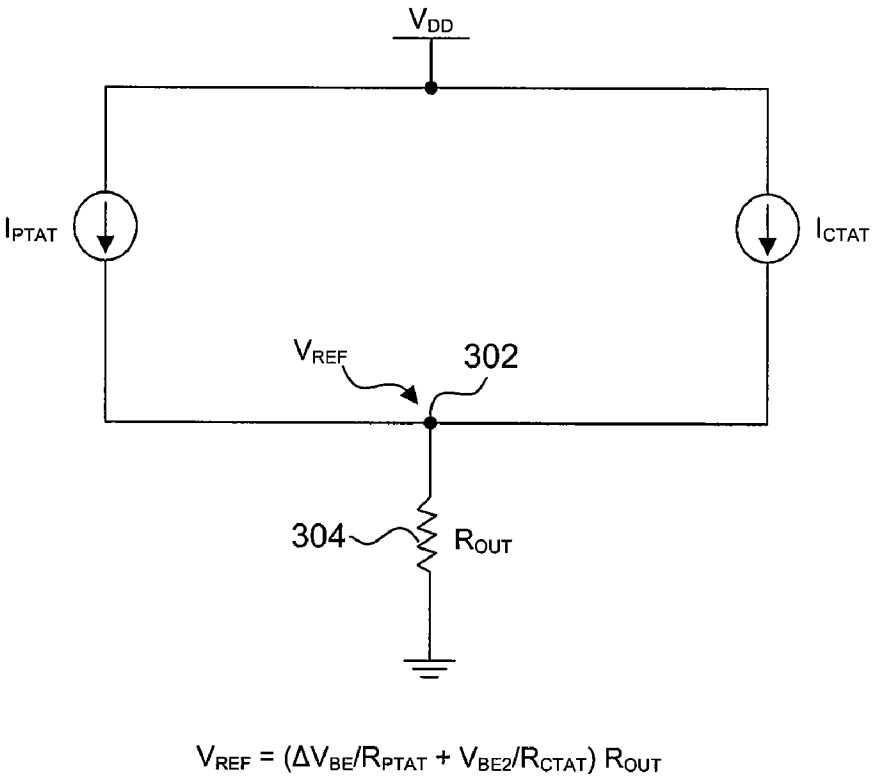
FIG. 3 illustrates an example output stage of a bandgap voltage reference circuit.

FIG. 3 illustrates an example output stage 300 of a bandgap voltage reference circuit. As shown in FIG. 3, output stage 300 combines mirror currents of $I_{PTAT}$ and $I_{CTAT}$ to generate a bandgap voltage reference $V_{REF}$ 302 across an output resistor $R_{OUT}$ 304. It is noted that when $R_{OUT}$ 304 is made of same material as $R_{PTAT}$ 106 and $R_{CTAT}$ 108 and experiences the same temperature as $R_{PTAT}$ 106 and $R_{CTAT}$ 108 (e.g., poly resistors integrated on the same chip), then the resulting voltage contributions of $I_{PTAT}$ and $I_{CTAT}$ across $R_{OUT}$ 304 will be respectively a directly proportional to temperature voltage and an inversely proportional to temperature voltage. In other words, in the product of $I_{PTAT}$ and $R_{OUT}$ 304, the temperature coefficient of $R_{PTAT}$ 106 will be cancelled by that of $R_{OUT}$ 304, resulting in $I_{PTAT}*R_{OUT}$ having a temperature coefficient directly proportional to temperature. Similarly, in the product of $I_{CTAT}$ and $R_{OUT}$ 304, the temperature coefficient of $R_{CTAT}$ 108 will be cancelled by that of $R_{OUT}$, resulting in $I_{CTAT}*R_{OUT}$ having a temperature coefficient inversely proportional to temperature. With proper weights, $I_{PTAT}*R_{OUT}$ and $I_{CTAT}*R_{OUT}$ can be combined to generate the bandgap voltage reference $V_{REF}$ 302 with minimal or no temperature dependence.

In the foregoing, it is assumed that $R_{PTAT}$ 106, $R_{CTAT}$ 108, and $R_{OUT}$ 304 are made of the same material and experience the same temperature.

Example Curvature Compensation Implementations

In theory, $I_{PTAT}*R_{OUT}$ is linearly proportional to temperature. However, the dependence of $I_{CTAT}*R_{OUT}$ on temperature includes some non-linearity. Thus, complete cancellation of temperature dependence in the bandgap voltage reference, $V_{REF}$, is not possible through linear combination of $I_{PTAT}*R_{OUT}$ and $I_{CTAT}*R_{OUT}$. As a result, the bandgap voltage reference, $V_{REF}$, typically exhibits a curvature (non-linear, parabolic) shape versus temperature, rather than a flat temperature-independent shape. This behavior is shown by example plot 1102 of $V_{REF}$ versus temperature in FIG. 11. It is noted that in the example of FIG. 11, $V_{REF}$ has a nominal value of approximately 900 mV. Thus, the actual $V_{REF}$ is higher than the nominal value when temperature is within the range from ~(−20° C.) to ~100° C., but lower than the nominal value when temperature is outside this range.

While a curvature shaped $V_{REF}$ is acceptable in many applications, certain high precision applications have much more exacting requirements for reference voltage stability versus temperature. There is a need therefore for methods and systems that generate a curvature-compensated bandgap voltage reference.

Figure 4:
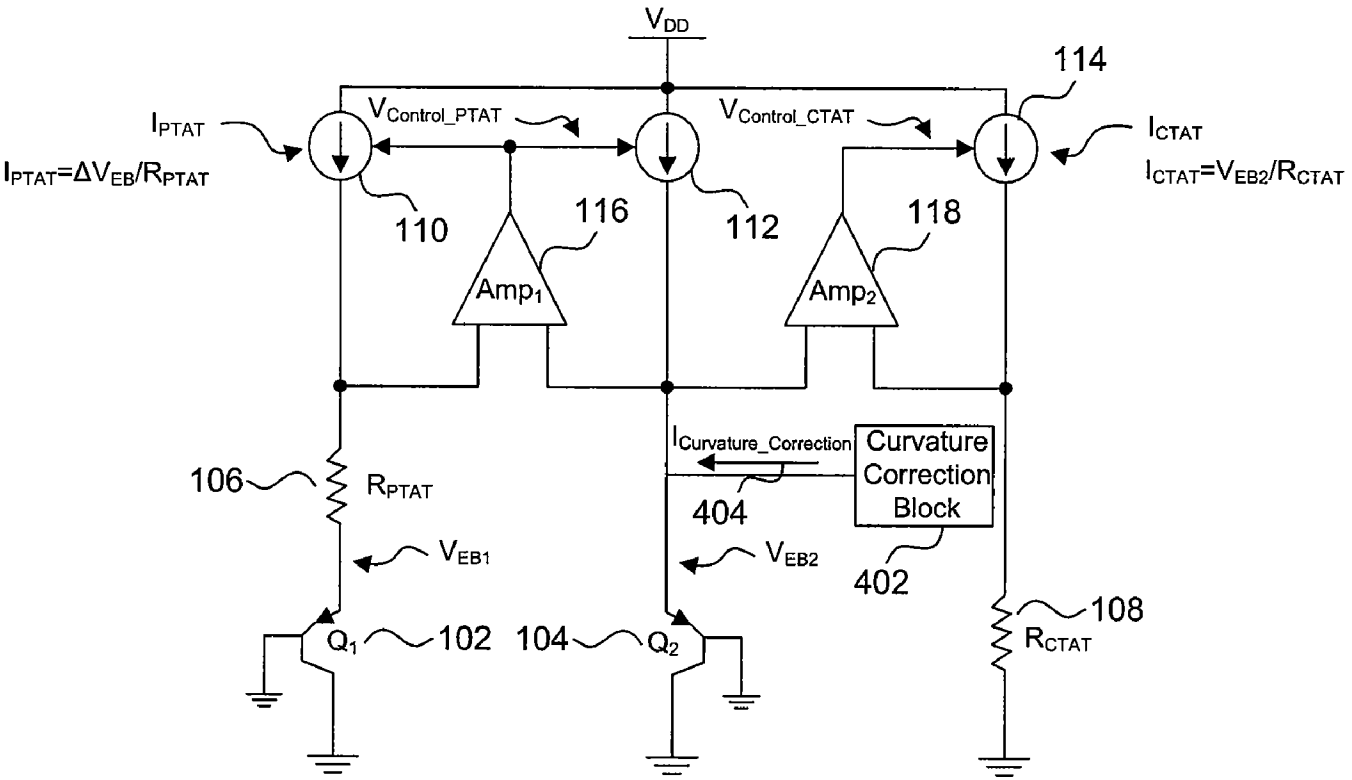
FIG. 4 illustrates an example implementation for applying curvature compensation in a bandgap voltage reference circuit according to an embodiment of the present invention.

FIG. 4 illustrates an example implementation 400 for applying curvature compensation in a bandgap voltage reference circuit according to an embodiment of the present invention. For ease of presentation, example implementation 400 is illustrated with respect to example bandgap voltage reference circuit 100, described above in FIG. 1. Example implementation 400 may also be used to apply curvature compensation in example bandgap voltage reference circuit 200, described above in FIG. 2.

As shown in FIG. 4, example implementation 400 includes applying a curvature correction circuit 402 at the emitter terminal of transistor Q2 104.

Curvature correction circuit 402 generates a temperature dependent current, curvature correction current $I_{Curvature_Correction}$ 404. In an embodiment, curvature correction circuit 402 may control one or more of the magnitude, polarity, and temperature coefficient of curvature correction current $I_{Curvature_Correction}$ 404 based on temperature.

By applying curvature correction circuit 402 at the emitter terminal of transistor Q2 104, curvature correction circuit 402 can affect the current flowing through Q2 104. For example, by injecting curvature correction current as shown in FIG. 4, curvature correction circuit 402 increases the emitter current of Q2 104. In turn, an increase in the emitter current of Q2 104 results in an increase in the emitter-to-base voltage, $V_{EB2}$, of Q2 104, and a corresponding increase in $I_{CTAT}$. Similarly, curvature correction circuit 402 may sink in current to decrease the emitter current of Q2 104 and to lower $I_{CTAT}$. (Note that the emitter current in a BJT is a function of the emitter-to-base voltage according to $$I_E \sim I_S \times e^{\frac{V_{EB}}{V_T}},$$

where $I_S$ is the saturation current and $V_T$ is the thermal voltage).

With control over $I_{CTAT}$ as described above, curvature correction circuit 402 can thus be designed to cancel out the non-linear dependence of $I_{CTAT}*R_{OUT}$ on temperature, in order to generate a more flat bandgap voltage reference. In an embodiment, the curvature correction current 402 injects curvature correction current at lower and higher temperatures of the temperature operating range, and sinks in (or takes out) current for mid range temperatures.

Figure 5:
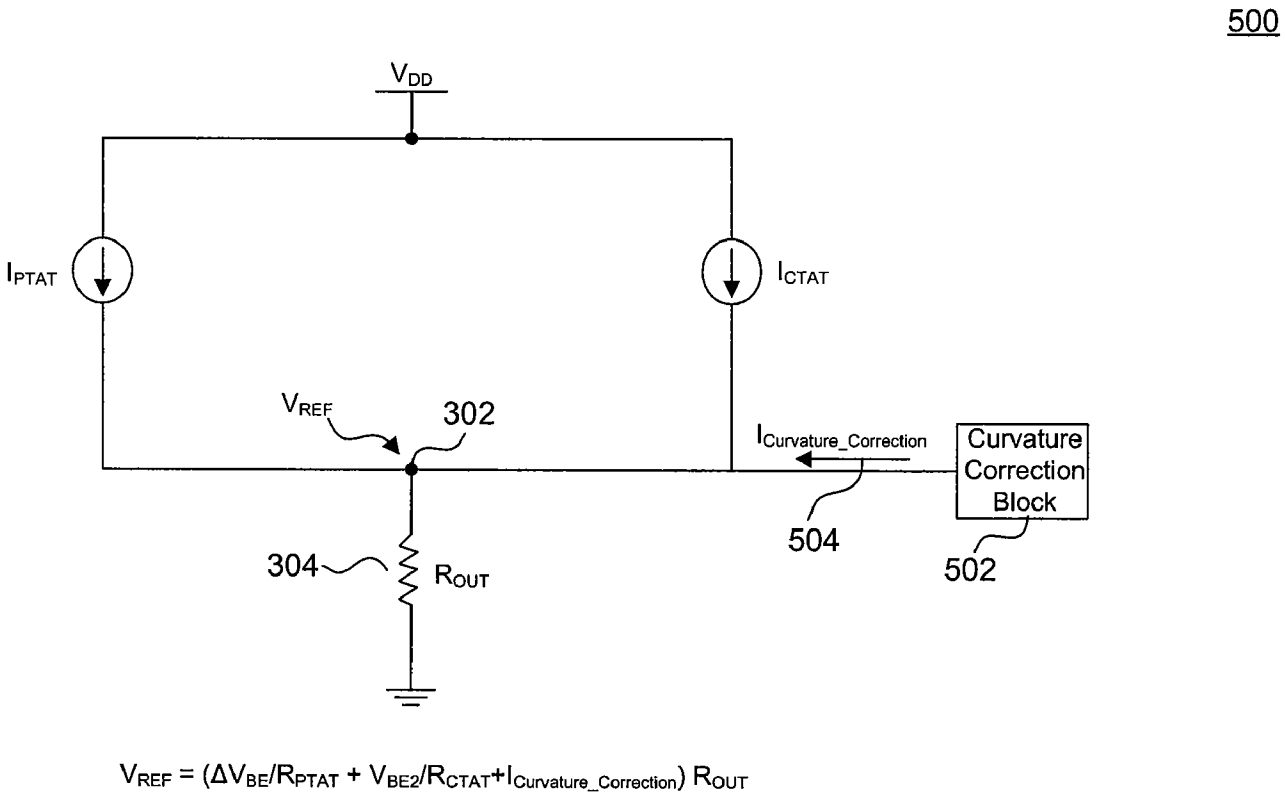
FIG. 5 illustrates another example implementation for applying curvature compensation in a bandgap voltage reference circuit according to an embodiment of the present invention.

FIG. 5 illustrates another example implementation 500 for applying curvature compensation in a bandgap voltage reference circuit according to an embodiment of the present invention. For ease of presentation, example implementation 500 is illustrated with respect to example output stage 300, described above in FIG. 3.

As shown in FIG. 5, example implementation 500 includes applying curvature compensation at the output stage of a bandgap voltage reference circuit, rather than at the $I_{PTAT}$, $I_{CTAT}$ current generation block of the bandgap circuit. In an embodiment, as shown in FIG. 5, the curvature correction current $I_{Curvature_Correction}$ 504 is injected at the $V_{REF}$ output node 302, thereby directly affecting the total current flowing through $R_{OUT}$ 304 (which is now the sum of $I_{PTAT}$, $I_{CTAT}$, and $I_{Curvature_Correction}$ 504), and $V_{REF}$.

It is noted that identical curvature compensation performance can be achieved using example implementations 400 and 500. However, generally, the curvature correction current in example implementation 500 will be scaled up in magnitude relative to the curvature correction current in example implementation 400. Therefore, example implementation 500 may consume more power. However, in certain applications, it may be desirable to work with larger currents, in which case example implementation 500 may be more suitable than example implementation 400.

Example Curvature Correction Circuits

Figure 6:
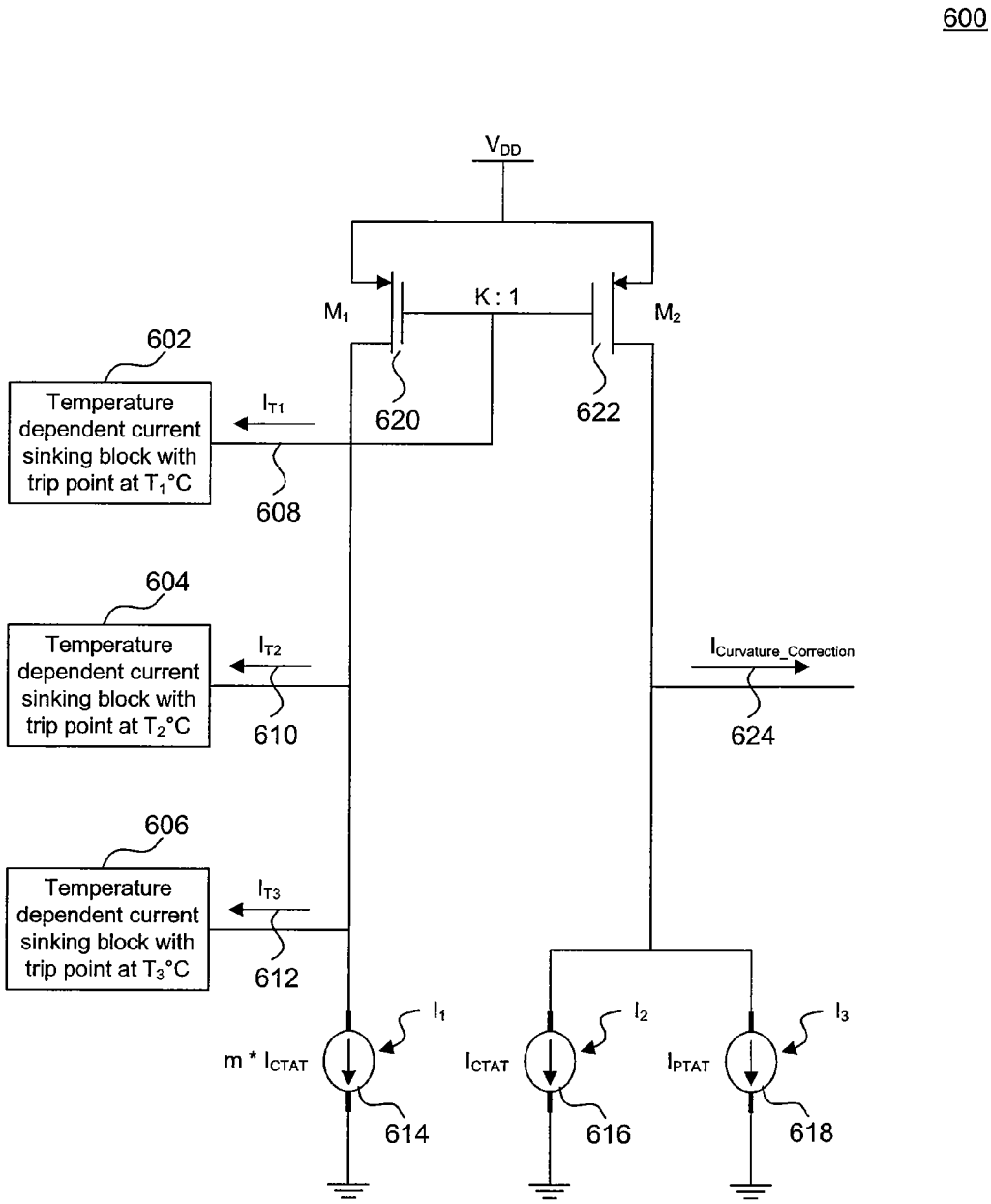
FIG. 6 illustrates an example curvature correction circuit according to an embodiment of the present invention.

FIG. 6 illustrates an example curvature correction circuit 600 according to an embodiment of the present invention. Curvature correction circuit 600 may be used, for example, for curvature correction block 402 in example implementation 400, shown in FIG. 4, or for curvature correction block 502 in example implementation 500, shown in FIG. 5.

As shown in FIG. 6, curvature correction circuit 600 includes a plurality of temperature dependent current sinking circuits 602, 604, and 606; a plurality of current sources 614, 616, and 618; and a current mirror formed by PMOS transistors M1 620 and M2 622. In an alternative embodiment, as would be understood by a person skilled in the art based on the teachings herein, the curvature correction circuit may be implemented using a plurality of temperature dependent current sourcing circuits instead of the current sinking circuits.

Temperature dependent current sinking circuits 602, 604, and 606 operate by sinking in respective currents $I_{T1}$ 608, $I_{T2}$ 610, and $I_{T3}$ 612 at respective temperature trip points $T_1$, $T_2$, and $T_3$. For example, when the circuit temperature exceeds $T_1$, current sinking circuit 602 will begin to sink in current $I_{T1}$ 608, as shown in FIG. 6. Similarly, current sinking circuits 604 and 606 will begin to sink in respective currents $I_{T2}$ 610 and $I_{T3}$ 612 when the circuit temperature exceeds $T_2$ and $T_3$, respectively. In an embodiment, $T_1$ is lower than $T_2$, which is lower than $T_3$. As will be understood by a person skilled in the art based on the teachings herein, curvature correction circuit 600 may include any integer number of temperature dependent current sinking circuits, depending on the desired shape of the curvature correction current, generated by curvature correction circuit 600.

Current source 614 ensures that a current $I_1$, which is proportional to $I_{CTAT}$ as determined by a multiplying factor m, continuously flows through PMOS transistor M1 620. In an embodiment, current source 614 sinks current starting at 0° K. Accordingly, the current that flows through PMOS transistor M1 620 is equal to $I_1$ for temperatures below $T_1$, $I_1+I_{T1}$ for temperatures above $T_1$ but below $T_2$, $I_1+I_{T1}+I_{T2}$ for temperatures above $T_2$ but below T3, and $I_1+I_{T1}+I_{T2}+I_{T3}$ for temperatures above $T_3$.

The current mirror formed by PMOS transistors M1 620 and M2 622 operates to mirror the current that flows in M1 620 into M2 622. In an embodiment, a K:1 scaling ratio is used in mirroring the current of M1 620 into M2 622. The K:1 scaling ratio is determined and may be adjusted as needed to null out the parabolic behavior of $V_{REF}$, as described above. Furthermore, the K:1 scaling ratio may depend on the particular implementation used to apply curvature correction, as described above.

Further, as shown in FIG. 6, in an embodiment, current sources $I_2$ 616 and $I_3$ 618 are coupled at the output of curvature correction circuit 600. Current sources $I_2$ 616 and $I_3$ 618 cause respective currents equal to $I_{CTAT}$ and $I_{PTAT}$, respectively, to flow through them respectively. As such, the curvature correction current 624, output by curvature correction circuit 600, is offset by the sum of $I_{CTAT}$ and $I_{PTAT}$. This has the effect of shifting down curvature correction current 624 to have an average of zero over temperature, thereby ensuring that $V_{REF}$ has a zero DC shift with respect to its value when no curvature correction is being used.

As mentioned above, current $I_1$ is proportional to $I_{CTAT}$, and thus has a negative temperature coefficient. However, temperature dependent current sinking circuits 602, 604, and 606 are configured such that respective currents $I_{T1}$ 608, $I_{T2}$ 610, and $I_{T3}$ 612 all have positive temperature coefficients.

Accordingly, the temperature coefficient of curvature correction current 624 will increase as each of temperature dependent current sinking circuits 602, 604, and 606 begins to sink current as described above. In an embodiment, the temperature coefficient of curvature correction current 624 will be most negative for temperatures below $T_1$ (for which none of $I_{T1}$ 608, $I_{T2}$ 610, and $I_{T3}$ 612 are present), less negative for temperatures above $T_1$ but below $T_2$ (for which $I_{T1}$ 608 is present), positive for temperatures above $T_2$ but below $T_3$ (for which $I_{T1}$ 608 and $I_{T2}$ 610 are present), and most positive for temperatures above $T_3$ (for which $I_{T1}$ 608, $I_{T2}$ 610, and $I_{T3}$ 612 are all present). In another embodiment, curvature correction current 624 varies according to a linear piecewise continuous function having four segments over the temperature range encompassing $T_1$, $T_2$, and $T_3$. The slope associated with each segment represents the temperature coefficient of curvature correction current 624 over the segment.

As will be understood by a person skilled in the art based on the teachings herein, the number of segments in the curvature correction current function depends on the number of temperature dependent current sinking circuits in curvature correction circuit 600, as well as the respective temperatures associated with the current sinking circuits. In general, the function will have N+1 segments when distinct temperatures are associated with the current sinking circuits, where N represents the number of current sinking circuits in curvature correction circuit 600. Further, as would be understood by a person skilled in the art based on the teachings herein, embodiments of the present invention are not limited to the example curvature correction circuits described herein. Accordingly, curvature correction current functions according to embodiments of the present invention are not limited to functions having four segments, as described above, but can be extended to any number of segments over the temperature range. As would be understood by a person skilled in the art, the more segments that the curvature correction current function has, the more precise is the cancellation of the parabolic $V_{REF}$ behavior.

Figure 7:
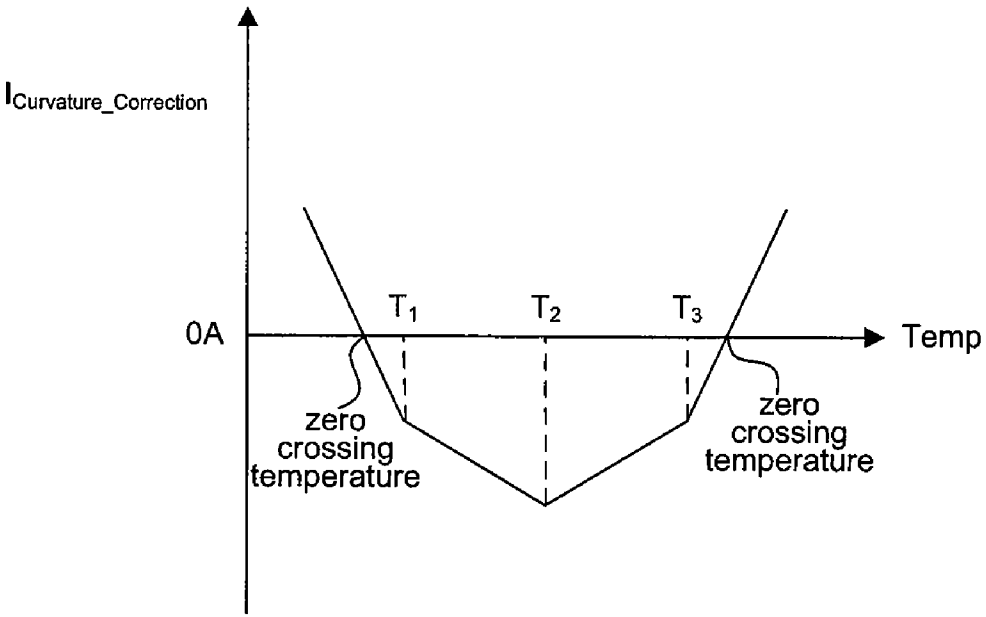
FIG. 7 illustrates an example transfer function of curvature correction current versus temperature according to an embodiment of the present invention.

FIG. 7 illustrates an example transfer function of curvature correction current 624 versus temperature according to an embodiment of the present invention. As shown in FIG. 7, example curvature correction current 624 exhibits a temperature dependence behavior as described above, namely an increasing temperature coefficient versus temperature. Further, in FIG. 7, temperatures $T_1$, $T_2$, and $T_3$ correspond respectively to temperatures $T_1$, $T_2$, and $T_3$ associated respectively with current sinking circuits 602, 604, and 606 in FIG. 6. Thus, FIG. 7 also shows the impact of each of currents $I_{T1}$ 608, $I_{T2}$ 610, and $I_{T3}$ 612 on the temperature coefficient of curvature correction current 624. In addition, FIG. 7 shows the temperatures at which curvature correction circuit 600 switches from injecting current to sinking current, or vice versa, as described above in FIG. 4. These temperatures are reflected in FIG. 7 by the temperatures that correspond to zero crossings of curvature correction current 624. For example, as curvature correction current 624 undergoes a positive to negative transition, curvature correction circuit 600 switches from injecting current to sinking current, as described above in FIG. 4. Then, when curvature correction current 624 undergoes a negative to positive transition, curvature correction circuit 600 switches from sinking current to injecting current, as described above in FIG. 4.

Figure 11:
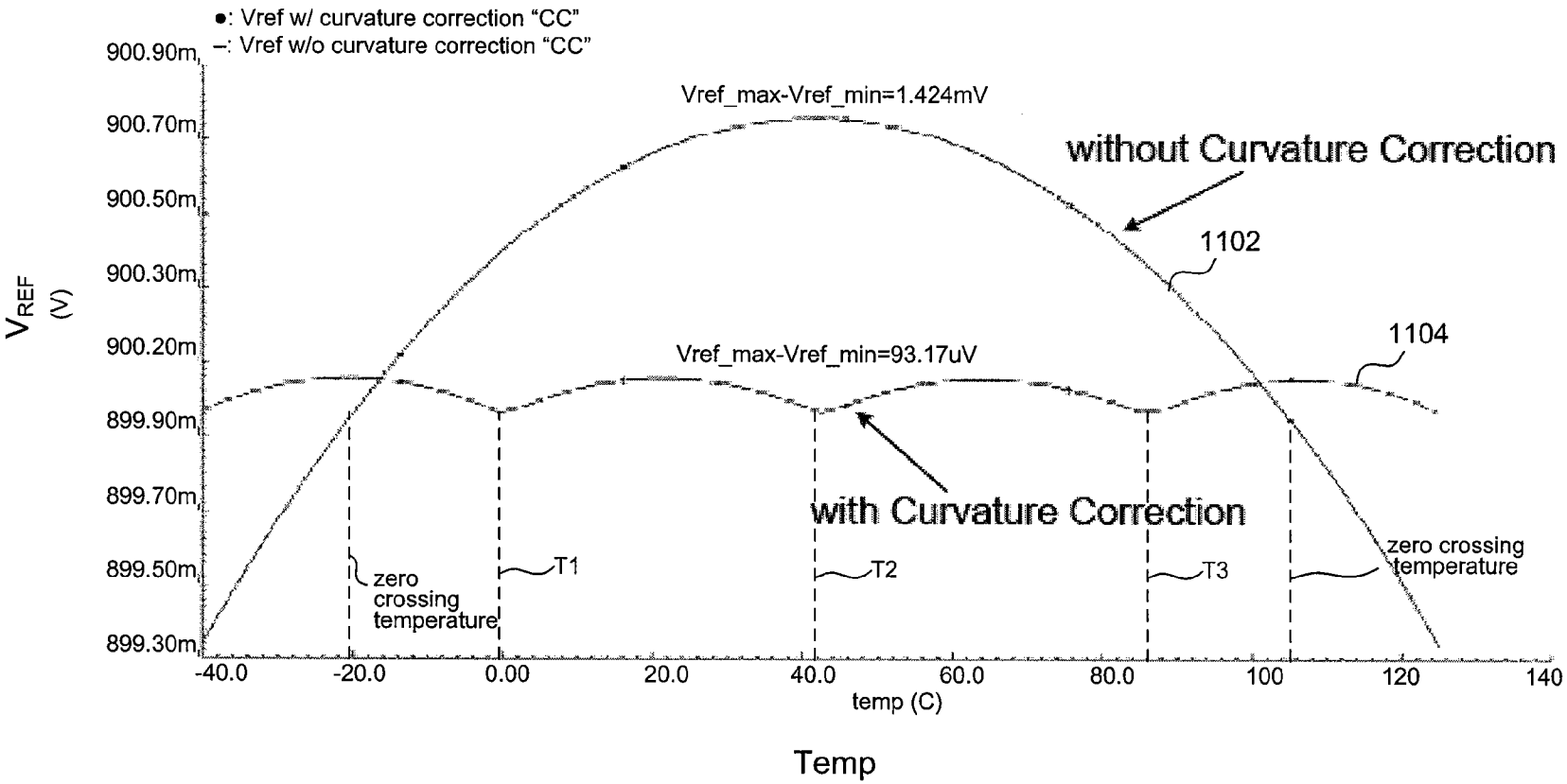
FIG. 11 illustrates the curvature compensation performance of an example curvature correction circuit according to an embodiment of the present invention.

It is further noted from FIG. 7 that the temperature dependence of curvature correction current 624 is approximately opposite to that of $V_{REF}$ without curvature compensation (as noted above, a finer approximation can be obtained by using a higher number of current sinking circuits). For example, as shown by example plot 1102 of $V_{REF}$ versus temperature in FIG. 11, $V_{REF}$ has a temperature coefficient that decreases with temperature. More particularly, considering the slope of plot 1102 (i.e., the temperature coefficient of $V_{REF}$) over temperature segments that correspond to the temperature segments shown in FIG. 7, it can be noted that $V_{REF}$'s temperature coefficient is most positive over the segment of temperatures below $T_1$, less positive over the segment $T_1$-$T_2$, negative over the segment $T_2$-$T_3$, and most negative over the segment above $T_3$. Furthermore, the polarity of curvature correction current 624 (i.e., whether curvature correction current 624 is positive or negative) is directly related to $V_{REF}$. For example, in the temperature segment below the first zero crossing temperature (or above the second zero crossing temperature) in FIG. 11, $V_{REF}$ is below its nominal value (which should be approximately 900 mV). Therefore, to compensate for this deficiency, curvature correction current 624 is positive over that same segment as shown in FIG. 7 (i.e., injecting current). However, when $V_{REF}$ exceeds its nominal value (in the segment between the two zero crossing temperatures as shown in FIG. 11), curvature correction current 624 turns negative to compensate the excess of $V_{REF}$ over its nominal value (i.e., sinking current).

Example Temperature Dependent Current Sinking Circuits

As described above, one component of a curvature correction circuit according to embodiments of the present invention is a temperature dependent current sinking circuit, which operates by sinking a pre-determined current when the circuit temperature exceeds a pre-determined temperature. Example implementations of temperature dependent current sinking circuits will now be provided. However, as would be understood by a person skilled in the art based on the teachings herein, current sinking circuits according to embodiments of the present invention are not limited to the examples provided herein. For example, a person skilled in the art would understand that any other implementation of current sinking circuits which achieve the objective noted above can be used in curvature correction circuits according to embodiments of the present invention.

In an example implementation, temperature dependent current sinking circuits according to embodiments of the present invention employ a temperature trip point monitoring circuit. In an embodiment, the temperature trip point monitoring circuit can be used as a temperature sensor to detect when the temperature exceeds a pre-determined temperature trip point. In another embodiment, the temperature trip point monitoring circuit generates a current when the temperature exceeds the pre-determined temperature trip point. In an embodiment, the generated current is directly proportional to temperature. In an alternative embodiment, the generated current is inversely proportional to temperature.

Figure 8:
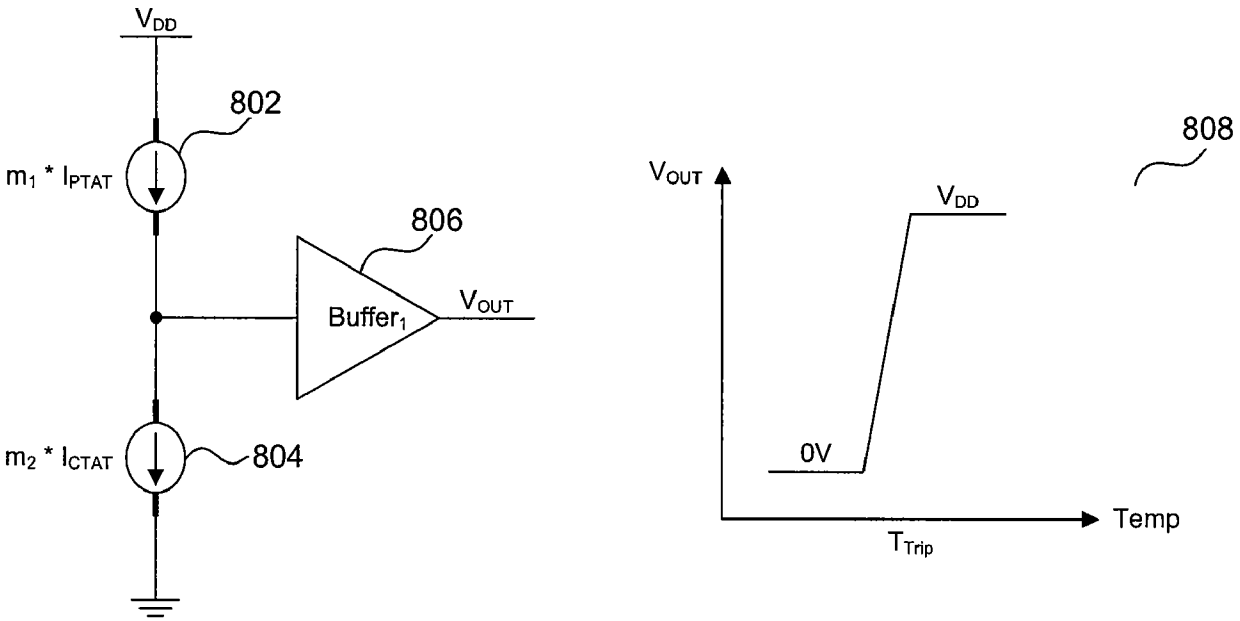
FIG. 8 illustrates an example implementation of a temperature trip point monitoring circuit according to an embodiment of the present invention.
Figure 9:
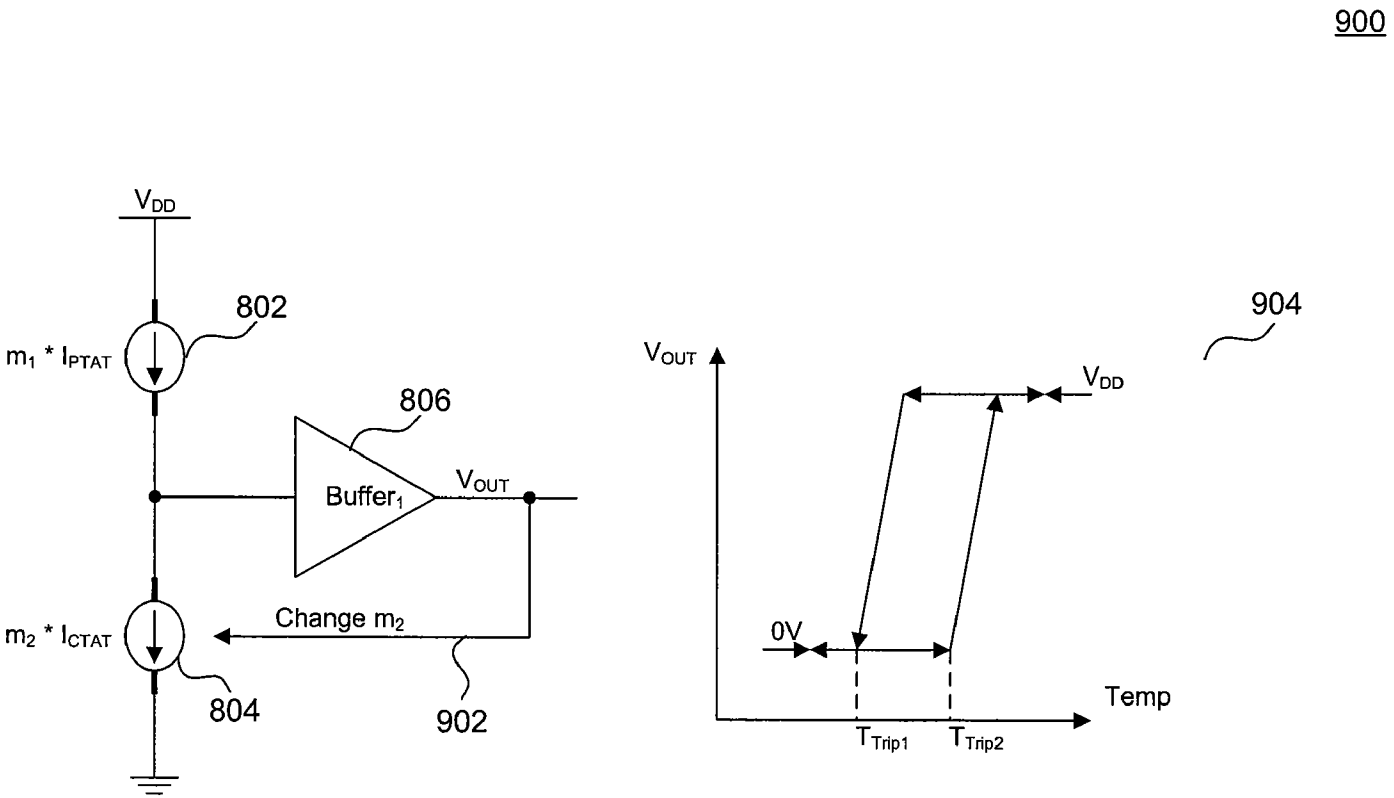
FIG. 9 illustrates another example implementation of a temperature trip point monitoring circuit according to an embodiment of the present invention.

Example temperature trip point monitoring circuits according to embodiments of the present invention are provided in FIGS. 8 and 9. As would be understood by a person skilled in the art, embodiments of the present invention are not limited by the examples described herein. For example, a person skilled in the art would understand that any other implementation of temperature trip point monitoring circuits which achieve the objective noted above can be used in curvature correction circuits according to embodiments of the present invention.

FIG. 8 illustrates an example implementation 800 of a temperature trip point monitoring circuit according to an embodiment of the present invention.

As shown in FIG. 8, the temperature trip point monitoring circuit includes a first current source 802, a second current source 804, and a buffer circuit 806. In an embodiment, first current source 802 generates a first current equal to $m_1 \times I_{PTAT}$, and second current source 804 generates a second current equal to $m_2 \times I_{CTAT}$. In an embodiment, the PTAT and CTAT currents generated by the $I_{PTAT}$, $I_{CTAT}$ current generation block (described above in FIG. 1) of the bandgap voltage reference circuit are mirrored with gain factors $m_1$ and $m_2$, respectively, to generate the first and the second currents.

In an embodiment, the ratio of the first current ($m_1 \times I_{PTAT}$) and the second current ($m_2 \times I_{CTAT}$) determines the temperature trip point of the temperature trip point monitoring circuit. Thus, the temperature trip point monitoring circuit can be adapted to have a desired temperature trip point by adjusting the ratio of $m_1$ and $m_2$. For example, when the ratio of $m_1$ and $m_2$ is equal to 1, the temperature trip point corresponds to the mid-range temperature value (approximately 42.5° C.), at which $V_{REF}$ exhibits zero temperature dependence.

With buffer 806 (which may be a high gain amplifier, for example) coupled between current source 802 and 804 as shown in FIG. 8, the output of buffer 806 versus temperature will be a step function as illustrated by step function 808. In other words, the output of buffer 806 will be a logic low (e.g., 0 V) when the temperature is below the temperature trip point as determined by the ratio of $m_1$ and $m_2$, and a logic high (e.g., $V_{DD}$) when the temperature exceeds the temperature trip point.

FIG. 9 illustrates another example implementation 900 of a temperature trip point monitoring circuit according to an embodiment of the present invention. Example implementation 900 is similar to example implementation 800, described in FIG. 8, but additionally includes a hysteresis function which allows the temperature trip point to be varied according to the output of buffer 806. In an embodiment, this is done by varying the gain factor $m_2$ using a feedback control signal 902, as shown in FIG. 9. Alternatively, the gain factor $m_1$ can be varied. Example implementation 900 allows control of the circuit based on one or more different temperatures. Step function 904 illustrates an example transfer function of example implementation 900.

It is noted that example implementations 800 and 900 can also be implemented by reversing the positions of first current source 802 and second current source 804. Accordingly, the output of buffer 806 versus temperature will exhibit an opposite step function to step function 808. In other words, the output of buffer 806 will be a logic high (e.g., $V_{DD}$) when the temperature is below the temperature trip point as determined by the ratio of $m_1$ and $m_2$, and a logic low (e.g., 0 V) when the temperature exceeds the temperature trip point.

Figure 10:
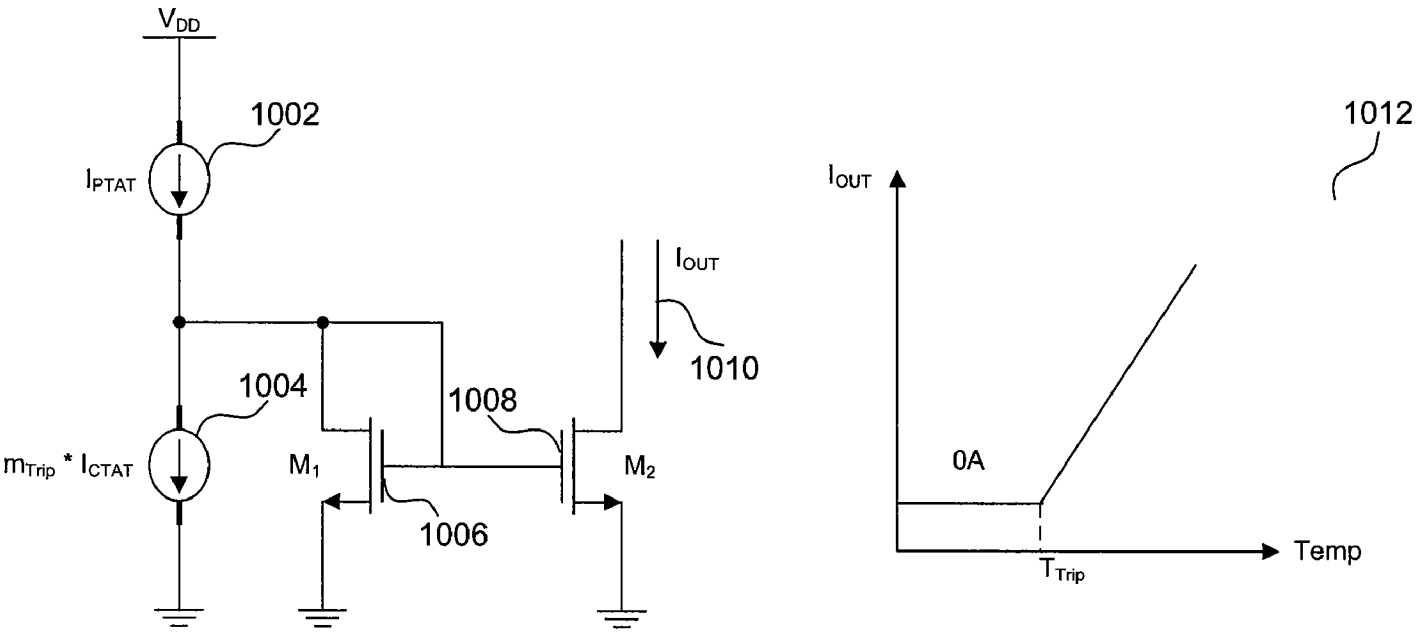
FIG. 10 illustrates an example implementation of a temperature dependent current sinking circuit according to an embodiment of the present invention.

FIG. 10 illustrates an example implementation 1000 of a temperature dependent current sinking circuit according to an embodiment of the present invention. As shown in FIG. 10, the temperature dependent current sinking circuit includes a temperature trip point monitoring circuit, including current sources 1002 and 1004, and a current mirror circuit, including NMOS transistors M1 1006 and M2 1008. As would be understood by a person skilled in the art based on the teachings herein, a temperature dependent current sourcing circuit may also be implemented according to embodiments of the present invention.

In an embodiment, as shown in FIG. 10, current source 1002 generates a first current equal to $I_{PTAT}$, and second current source 1004 generates a second current equal to $m_{Trip} \times I_{CTAT}$. In an embodiment, the PTAT and CTAT currents generated by the PTAT and CTAT current generation block (described above in FIG. 1) of the bandgap voltage reference circuit are mirrored with gain factors of 1 and $m_{Trip}$, respectively, to generate the first and the second currents. As described above, the ratio of the first current ($I_{PTAT}$) and the second current ($m_{Trip} \times I_{CTAT}$) determines the temperature trip point of the temperature trip point monitoring circuit. Thus, the temperature trip point monitoring circuit can be adapted to have a desired temperature trip point by adjusting $m_{Trip}$.

As shown in FIG. 10, the output current of the current sinking circuit, $I_{OUT}$ 1010, is a mirror of the current that flows in transistor M1 1006. Accordingly, $I_{OUT}$ 1010 will have a transfer function versus temperature as shown by transfer function 1012. In particular, $I_{OUT}$ 1010 will be zero for temperatures below the temperature trip point of the current sinking circuit, and non-zero and proportional to temperature for temperatures above the temperature trip point. This is because, for temperatures below the temperature trip point, the current ($m_{Trip} \times I_{CTAT}$) generated by second current source 1004 will be larger than the current ($I_{PTAT}$) generated by first current source 1002, pulling down the drain and gate terminals of transistor M1 1006 to zero and resulting in zero current flow in M1 1006. However, for temperatures above the temperature trip point, the current ($I_{PTAT}$) generated by first current source 1002 will be larger than the current ($m_{Trip} \times I_{CTAT}$) generated by second current source 1004, resulting in the excess of the first current over the second current to flow through M1 1006 and to be mirrored out in M2 1008.

As would be understood by a person skilled in the art based on the teachings herein, embodiments of the present invention are not limited to those having output current transfer functions as illustrated in example implementation 1000. For example, in other embodiments, other output current transfer functions may be designed, including transfer functions in which the output current may take negative values as well as exhibit negative temperature dependence.

Example Performance Evaluation

FIG. 11 illustrates the curvature compensation performance of an example curvature correction circuit according to an embodiment of the present invention. In particular, FIG. 11 shows two example plots 1102 and 1104 of the bandgap voltage reference, $V_{REF}$, versus temperature.

Example plot 1102 shows the bandgap voltage reference versus temperature, without curvature compensation. As described above and can be noted from plot 1102, the bandgap voltage reference exhibits a parabolic behavior versus temperature without curvature compensation.

Example plot 1104 corresponds to the bandgap voltage reference versus temperature, with curvature compensation applied according to an embodiment of the present invention. In the example of FIG. 11, the curvature compensation circuit used has a curvature correction current transfer function as shown in FIG. 7. In other words, the curvature correction circuit uses three temperature dependent current sinking circuits having respective temperature trip points $T_1$, $T_2$, and $T_3$. For the purpose of illustration, the temperature points shown on FIG. 7 are mapped respectively to the same labeled temperature points on FIG. 11. As such, the impact of each of the temperature dependent current sinking circuits on the bandgap voltage reference can be noted.

As shown in FIG. 11, the bandgap voltage reference stability versus temperature is significantly improved by using curvature compensation according to embodiments of the present invention. The parabolic behavior of the bandgap voltage reference is considerably cancelled out. Further, the minimum to maximum voltage variation range is reduced from approximately 1.424 mV without curvature compensation to approximately 93.17 μV with curvature compensation.

Conclusion

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A bandgap voltage reference circuit, comprising:

a current generation stage configured to generate a proportional to absolute temperature (PTAT) current and a complementary to absolute temperature (CTAT) current;

an output stage, coupled to the current generation stage, configured to combine the PTAT current and the CTAT current to generate a bandgap voltage reference; and a curvature correction circuit configured to generate a curvature correction current;

wherein the curvature correction current substantially cancels a non-linear dependence on temperature of the bandgap voltage reference when applied to the bandgap voltage reference circuit, thereby generating a curvature-compensated bandgap voltage reference, and wherein the curvature correction current is applied within the current generation stage of the bandgap voltage reference circuit.

2. The bandgap voltage reference circuit of claim 1, wherein the curvature correction circuit comprises a plurality of temperature dependent current sinking circuits, wherein each of the temperature dependent current sinking circuits is configured to generate a respective current when temperature exceeds a respective temperature trip point.

3. The bandgap voltage reference circuit of claim 2, wherein the curvature correction circuit comprises a temperature-independent current source, wherein the temperature-independent current source is configured to generate a current proportional to the CTAT current.

4. The bandgap voltage reference circuit of claim 3, wherein the curvature correction current is proportional to the sum of the currents generated by the plurality of temperature dependent current sinking circuits and the current generated by the temperature-independent current source.

5. The bandgap voltage reference circuit of claim 4, wherein the current generated by the temperature-independent current source has a negative temperature coefficient, and wherein the currents generated by the temperature dependent current sinking circuits have positive temperature coefficients.

6. The bandgap voltage reference circuit of claim 2, wherein each of the plurality of temperature dependent current sinking circuits comprises a temperature trip point monitoring circuit.

7. The bandgap voltage reference circuit of claim 1, wherein a temperature coefficient of the curvature correction current increases with temperature.

8. The bandgap voltage reference circuit of claim 1, wherein a temperature coefficient of the curvature correction current is approximately opposite to a temperature coefficient of the bandgap voltage reference over temperature.

9. The bandgap voltage reference circuit of claim 1, wherein the curvature correction current varies according to a linear piecewise continuous function versus temperature.

10. The bandgap voltage reference circuit of claim 1, wherein the curvature-compensated bandgap voltage reference is substantially independent of temperature.

11. A method for generating a curvature-compensated bandgap voltage reference in a bandgap voltage reference circuit, comprising:

generating a proportional to absolute temperature (PTAT) current and a complementary to absolute temperature (CTAT) current;

generating a curvature correction current using the PTAT current and the CTAT current, wherein the curvature correction current substantially cancels a non-linear dependence on temperature of a bandgap voltage reference generated using the PTAT and the CTAT current; and combining the curvature correction current with the PTAT current and the CTAT current to generate the curvature-compensated bandgap voltage reference, wherein combining the curvature correction current with the PTAT current and the CTAT current comprises applying the curvature correction current at a current generation stage of the bandgap voltage reference circuit.

12. The method of claim 11, wherein generating the curvature correction current comprises generating a current proportional to the CTAT current.

13. The method of claim 12, wherein generating the curvature correction current comprises generating a plurality of currents having positive temperature coefficients, and wherein each of the plurality of currents takes a non-zero value when temperature exceeds a respective temperature trip point.

14. The method of claim 13, wherein the curvature correction current is proportional to the sum of the current proportional to the CTAT current and the plurality of currents.

15. The method of claim 11, wherein a temperature coefficient of the curvature correction current increases with temperature.

16. The method of claim 11, wherein a temperature coefficient of the curvature correction current is approximately opposite to a temperature coefficient of the bandgap voltage reference over temperature.

17. The method of claim 11, wherein the curvature correction current varies according to a linear piecewise continuous function versus temperature.

18. The method of claim 11, wherein the curvature-compensated voltage reference is substantially independent of temperature.

19. A method for generating a curvature-compensated bandgap voltage reference in a bandgap voltage reference circuit, comprising:

generating a proportional to absolute temperature (PTAT) current and a complementary to absolute temperature (CTAT) current;

generating a curvature correction current using the PTAT current and the CTAT current, wherein the curvature correction current exhibits a parabolic dependence on temperature substantially opposite to a parabolic dependence on temperature of a bandgap voltage reference generated using the PTAT and the CTAT current; and combining the curvature correction current with the PTAT current and the CTAT current to generate the curvature-compensated bandgap voltage reference.

* * * * *